US005896683A

United States Patent [19]

Foxen et al.

[11] Patent Number: 5,896,683

[45] Date of Patent: Apr. 27, 1999

[54] INVERSION/EVERSION LIMITING SUPPORT

[75] Inventors: Thomas Foxen, Portland; Jeffrey L. Johnson, Lake Oswego, both of Oreg.

[73] Assignee: Nike, Inc., Beaverton, Oreg.

[21] Appl. No.: 08/866,091

[22] Filed: May 30, 1997

[51] Int. Cl.[6] ..... A43B 7/20

[52] U.S. Cl. ..... 36/89

[58] Field of Search ..... 36/89, 90, 92, 36/107, 57, 58, 132

[56] References Cited

U.S. PATENT DOCUMENTS

| | | |
|---|---|---|
| D. 386,603 | 11/1997 | Avar . |
| D. 386,895 | 12/1997 | Hatfield . |
| D. 388,499 | 12/1997 | Lucas . |
| D. 391,057 | 2/1998 | Cooper . |
| D. 393,351 | 4/1998 | Avar . |
| 737,959 | 9/1903 | Posner . |
| 874,862 | 12/1907 | Posner . |
| 983,576 | 2/1911 | Smith . |
| 990,567 | 4/1911 | Kreiger . |
| 994,849 | 6/1911 | Lieberman . |
| 1,192,433 | 7/1916 | Kreiger . |
| 1,441,677 | 1/1923 | Golden . |
| 1,548,172 | 8/1925 | Redden . |
| 1,586,698 | 6/1926 | Posner . |
| 2,302,694 | 11/1942 | Jennings . |
| 2,634,515 | 4/1953 | Saitta . |
| 2,945,309 | 7/1960 | Shapiro . |
| 3,028,861 | 4/1962 | Shapiro . |
| 4,756,098 | 7/1988 | Boggia . |
| 4,922,630 | 5/1990 | Robinson . |
| 4,947,560 | 8/1990 | Fuerst et al. . |
| 4,989,350 | 2/1991 | Bunch et al. . |
| 5,046,267 | 9/1991 | Kilgore et al. . |
| 5,113,526 | 5/1992 | Wang et al. . |
| 5,152,082 | 10/1992 | Culpepper . |
| 5,243,772 | 9/1993 | Francis et al. . |
| 5,247,742 | 9/1993 | Kilgore et al. . |
| 5,371,957 | 12/1994 | Gaudio . |
| 5,400,529 | 3/1995 | Bell et al. . |
| 5,423,134 | 6/1995 | Bagnaia et al. . |
| 5,430,959 | 7/1995 | Mitsui . |
| 5,454,172 | 10/1995 | Crigger . |
| 5,461,801 | 10/1995 | Anderton . |
| 5,465,509 | 11/1995 | Fuerst et al. . |
| 5,498,033 | 3/1996 | Hoshizaki et al. . |
| 5,588,228 | 12/1996 | Foscaro et al. . |

FOREIGN PATENT DOCUMENTS

| | | |
|---|---|---|
| 515639 | 12/1952 | Belgium . |
| 494979 | 8/1953 | Canada . |
| 0 273 891 A2 | 7/1988 | European Pat. Off. . |
| 0 465 223 A2 | 1/1992 | European Pat. Off. . |
| 1193946 | 11/1959 | France . |
| 856728 | 7/1949 | Germany . |
| 28 56 893 | 1/1980 | Germany . |
| 44 03 043 A1 | 8/1994 | Germany . |
| 9531 | 7/1886 | United Kingdom . |
| 15836 | 8/1888 | United Kingdom . |

OTHER PUBLICATIONS

Nike Fall 1997 Footwear Catalog, pp. 191, 29, published Dec. 1996.

Nike Holiday 1996 Footwear Catalog, p. 22, published Mar. 1996.

Nike Fall 1996 Footwear Catalog, pp. 44, 152, published Dec. 1995.

Nike Spring 1996 Footwear Catalog, pp. 40, 131, 138, published Jun. 1995.

*Primary Examiner*—Ted Kavanaugh

*Attorney, Agent, or Firm*—Banner & Witcoff, Ltd.

[57] ABSTRACT

An improved article of footwear for limiting inversion and eversion of the ankle is disclosed. The article of footwear includes at least one support which limits eversion and inversion while permitting a full range of motion in the plantar and dorsi flexion plane. The support includes a plurality of finger-like elements extending vertically upward from the sole along the upper The breadth of each finger-like element is greater than its width so that the element will freely bend in the dorsi and plantar flexion plane and not in the medial and lateral flexion plane. In a preferred embodiment of the invention, the article of footwear has supports located in the rear-foot, mid-foot and forefoot regions of the article of footwear for preventing inversion and eversion as well as for enhancing the fit of the article of footwear and containing the foot over the sole.

31 Claims, 7 Drawing Sheets

INVERSION/EVERSION LIMITING SUPPORT

TECHNICAL FIELD

The present invention relates to an improved, lightweight support for use with an article of footwear. More particularly, the present invention relates to a support which allows flexion of the foot and ankle in the heel/toe plane while resisting flexion in the medial/lateral plane.

BACKGROUND OF THE INVENTION

The ankle is one of the most frequently sprained joints in the body. The most common and often most severe ankle sprains are caused by excessive inversion or eversion. Inversion is the internal rotation of the ankle joint. Eversion is the external rotation of the ankle joint. The occurrence of injury to the ankle can be significantly reduced by limiting inversion and eversion. This can be accomplished by restricting medial and lateral motion of the ankle.

When restricting ankle motion, it is important not to hinder the natural plantar and dorsi motions of the foot and ankle, as this will lead to decreased performance during athletic activities. Plantar flexion is a toe-down motion of the foot at the ankle, and dorsi flexion is a toe-up motion of the foot at the ankle. The axis of motion for plantar and dorsi flexion must be considered when limiting any ankle motion.

Prior art devices and methods for minimizing the risk of a sprain include taping the ankle to immobilize it against excessive rotation and building support systems into articles of footwear. Taping the ankle of an athlete is a time consuming and expensive procedure which generally cannot be performed by the athlete. Rather, it requires a trainer with special knowledge of how to properly and effectively tape an ankle in order to protect it from being sprained. Taping an ankle can severely limit its natural plantar and dorsi flexion.

Prior art articles of footwear have attempted to deal with ankle injuries by incorporating support systems which limit ankle motion. These systems do not provide sufficient protection against inversion and eversion while allowing essentially unrestricted dorsi and plantar flexion. Instead, they use rigid members, elastic materials or straps which unnecessarily add to the overall weight of the article of footwear, make the article of footwear more cumbersome and uncomfortable and restrict plantar/dorsi flexion. An example of such a system is U.S. Pat. No. 2,634,515 to Saitta which discloses a spiked article of footwear having a plurality of stiffeners in the form of flat steel ribs located in pockets along the sides of the article of footwear for preventing eversion and inversion. The steel ribs significantly increase the overall weight of the article of footwear while impeding flexion in the dorsi and plantar flexion directions.

Recent attempts to incorporate ankle support systems into athletic footwear have resulted in footwear which insufficiently prevents inversion and eversion and/or significantly impedes dorsi/plantar flexion. U.S. Pat. No. 5,152,082 to Culpepper discloses an ankle support member formed from a stiff, resilient piece of bendable sheet material. The support member includes a base having a plurality of medial and lateral strips extending upwardly and rearwardly therefrom in the direction of the heel. The width of each strip is significantly greater than the distance it extends away from the interior wall of the article of footwear. Accordingly, each strip has great strength for resisting flexion in the plantar/dorsi flexion plane and little strength for resisting flexion in the medial/lateral plane. As a result, these strips prevent adequate flexion in the plantar and dorsi flexion plane while allowing inversion and eversion.

U.S. Pat. No. 4,989,350 to Bunch et al. discloses a high top article of footwear having sheet springs rigidly fixed to the upper of the article of footwear at points below the wearer's ankle. The springs are not affixed to the upper above the wearer's ankle so they do not move with the flexion of the article of footwear to fully support the ankle and foot no matter their positions. Further, the struts are designed so that they extend a distance along the length of the article of footwear which is greater than the distance they extend away from the article of footwear. As a result, the struts resist plantar/dorsi flexion more than they resist inversion and eversion.

U.S. Pat. No. 5,498,033 to Hoshizaki et al. discloses a hockey skate having a skate boot with a molded plastic overlay for restricting movement of the wearer's ankle. The overlay increases the rigidity of the rear of the skate to restrict medial and lateral movement of the ankle. The material of the overlay also resists dorsi and plantar flexion.

There is a decided need in the art for an article of footwear which limits inversion and eversion while providing the needed amount of flexibility in the plantar/dorsi flexion plane. There is also a decided need in the art for a support which is comfortable and conforms to the contour of the ankle and foot of a user.

It is an object of this invention to overcome the disadvantages of the prior art by providing a lightweight article of footwear having the optimum amount of flexibility, support and comfort.

SUMMARY OF THE INVENTION

The support according to the present invention allows flexion in the plantar/dorsi plane, the plane extending between the toe and heel regions of the foot, and resists flexion in the medial/lateral plane, the plane extending from the medial to the lateral side of the foot, in order to limit ankle eversion and inversion. The support also provides exceptional lateral stability and support when maneuvering to enhance the performance of the user during an athletic activity. It includes a base and a plurality of finger-like support elements extending from the base. Each of the finger-like support elements has a first surface for being placed proximate an article of footwear, a second surface for being placed distal an article of footwear and side surfaces extending between the first and second surfaces. Each of the finger-like support elements includes a breadth extending from the first surface to the second surface and a width extending between the side surfaces. The breadth is greater than the width so that there is greater resistance to flexion in the direction of the breadth that there is in the direction of the width.

According to the present invention, a portion of an article of footwear is formed of a material having first and second sides and a support attached thereto. The support includes a first portion extending along the first side of the material, a second portion extending along the second side of the material and a bridge portion extending through the material and connecting the first and second portions such that the support is securely attached to the material. The first and second portions and the bridge portion are formed of an integrally molded material. The first portion of the support includes at least one finger-like element having a length for extending along an article of footwear upper. The at least one finger-like element includes first and second sides and first and second surfaces which extend along its length. The first surface is located proximate the material and the second surface is located distal the material such that a distance from the first surface to the second surface is greater than a distance from the first side to the second side, An article of footwear according to the present invention comprises an upper and a sole operatively attached to each other and extending between a heel area and a toe area of the article of footwear. A support extends upward from the sole and includes a plurality of spaced apart, radially extending finger-like support elements along the upper and a support base reaching upward from the sole. The finger-like elements flex in a heel/toe flexion plane and resist flexion in a plane perpendicular to the heel/toe flexion plane. The base includes a lower portion which extends a distance along the sole in a direction transverse to the longitudinal axis of the article of footwear which is sufficient to support the base without affecting the comfort of the user while wearing the article of footwear. In an embodiment of the invention, the finger-like support elements and base are contoured and shaped such that they have curvature in a plane extending generally perpendicular to the heel/toe flexion plane to conform to the ankle region of the user.

According to the present invention, the longitudinal axis of an article of footwear extends between a heel region and a toe region, and a transverse axis extends generally horizontally and perpendicular to the longitudinal axis between medial and lateral sides of the article of footwear. A support including at least one finger-like support element extends vertically upward along the upper of the article of footwear. The at least one finger-like support element has a breadth extending generally parallel to the transverse axis of the article of footwear away from the upper and a width extending generally parallel to the longitudinal axis of the article of footwear. The breadth is greater than the width so that the at least one finger-like element flexes in the plantar/dorsi flexion plane and resists flexion in the medial/lateral flexion plane, thereby limiting eversion and inversion. In a preferred embodiment, the at least one finger-like support element includes a plurality of finger-like support elements.

In a preferred embodiment of the present invention, the article of footwear comprises a plurality of support sections spaced along its upper: a rear-foot section, a mid-foot section and a forefoot section. Each support section includes a plurality of finger-like support elements. The rear-foot section is the most rigid of the support sections and is centered about the malleolus when worn. The mid-foot section is more flexible than the rear-foot section and enhances the fit of the article of footwear about the person's foot while supporting the instep region of the wearer. The forefoot section can be more flexible than the mid-foot section and supports the foot so that it does not push out of the upper during use. The support sections may be incorporated on either side of the article of footwear with at least the rear foot sections being offset from one another so that they are centered about the inner malleolus and the outer malleolus, respectively.

The article of footwear according to the present invention has increased support for limiting inversion/eversion. The article of footwear comprises an upper operatively attached to a sole and extending between a heel area and a toe area thereof. A radially shaped support extends along the upper and includes a base and at least one flexible finger-like support element which extends from the base along the upper. The at least one finger-like support element is shaped so that it easily flexes in a heel/toe flexion plane and resists flexion in a direction perpendicular to the heel/toe flexion plane. The support also has a contour which conforms to the ankle region of a user so that the article of footwear comfortably receives and supports an ankle when worn. In a preferred embodiment of the invention, the at least one finger-like support element includes a plurality of spaced apart finger-like support elements centered over the ankle joint when the user is in a neutral standing position. Each finger-like element and their base are shaped to conform to an ankle region of a user. The finger like elements are independently flexible and joined together at the base by a web.

The present invention also includes a method of forming a component for use with an article of footwear. The method comprises the steps of providing a material layer having first and second sides and injection molding a thermoplastic onto the material layer. The method also comprises molding the thermoplastic into a support having a first portion on the first side of the material layer and a second portion on the second side of the material layer. A bridging portion is molded through the material layer and connects the first and second portions such that they are secured to the material. The injection molding can occur on a die cut layer of material which is then secured to the upper or it can occur on a layer which is already part of a lasted upper.

For a better understanding of the invention and its advantages, reference should be made to the accompanying drawings and descriptive matter which illustrate and describe the preferred embodiments of the invention.

DETAILED DESCRIPTION OF THE PREFERRED EMBODIMENT

Figure 1:
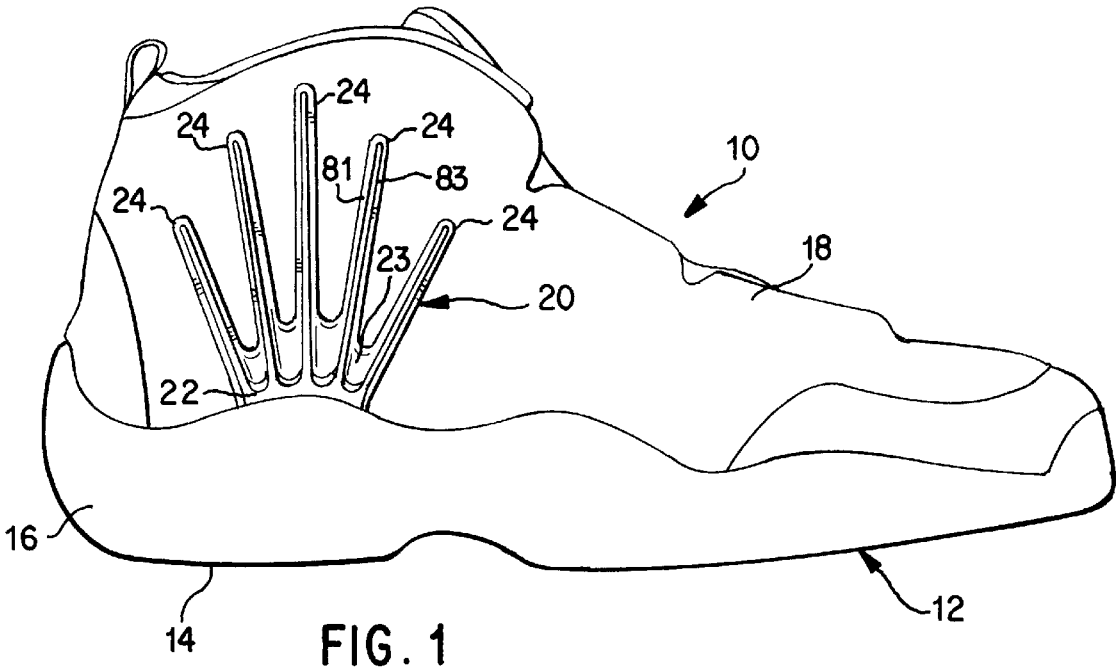
FIG. 1 is a side elevational view of an article of footwear including a support in accordance with the present invention.
Figure 2:
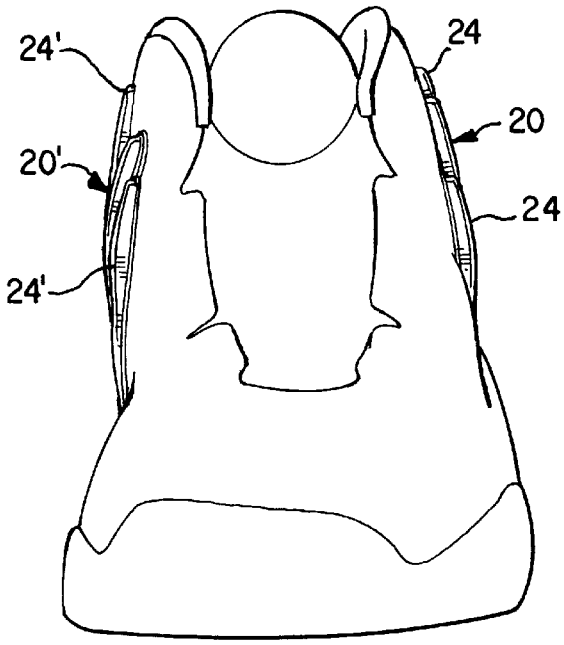
FIG. 2 is a front elevational view of an article of footwear including a support in accordance with the present invention.

FIG. 1 illustrates a preferred embodiment of an article of footwear 10 including a support 20 in accordance with the present invention. The article of footwear 10 includes a sole 12 fastened to an upper 18 in a conventional manner such as with an adhesive. Sole 12 can be of any conventional design. Preferably, sole 12 includes an outsole 14 and a midsole 16. Upper 18 has an outer layer 82 which can include fabrics, textiles, leather, suede, composites or a combination of some or all of these materials. Article of footwear 10 is fastened about the wearer's foot by conventional securing means such as lacing. The support 20 can be used with an article of footwear in which the upper and sole are connected in their operation.

Figure 3C:
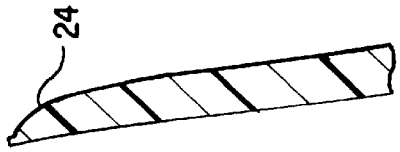
FIG. 3C is a cross section taken along the line C—C of FIG. 3.
Figure 3B:
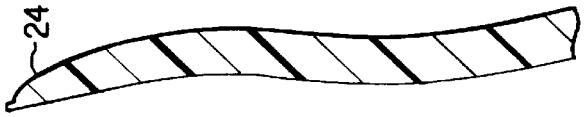
FIG. 3B is a cross section taken along the line B—B of FIG. 3.
Figure 3A:
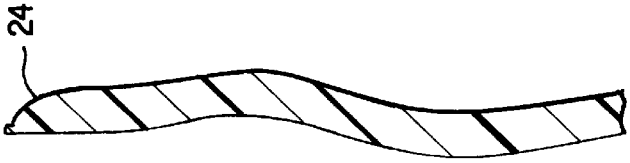
FIG. 3A is a cross section taken along the line A—A of FIG. 3.
Figure 3D:
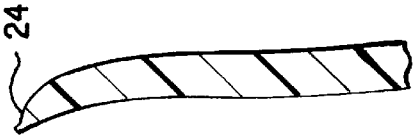
FIG. 3D is a cross section taken along the line D—D of FIG. 3.
Figure 3:
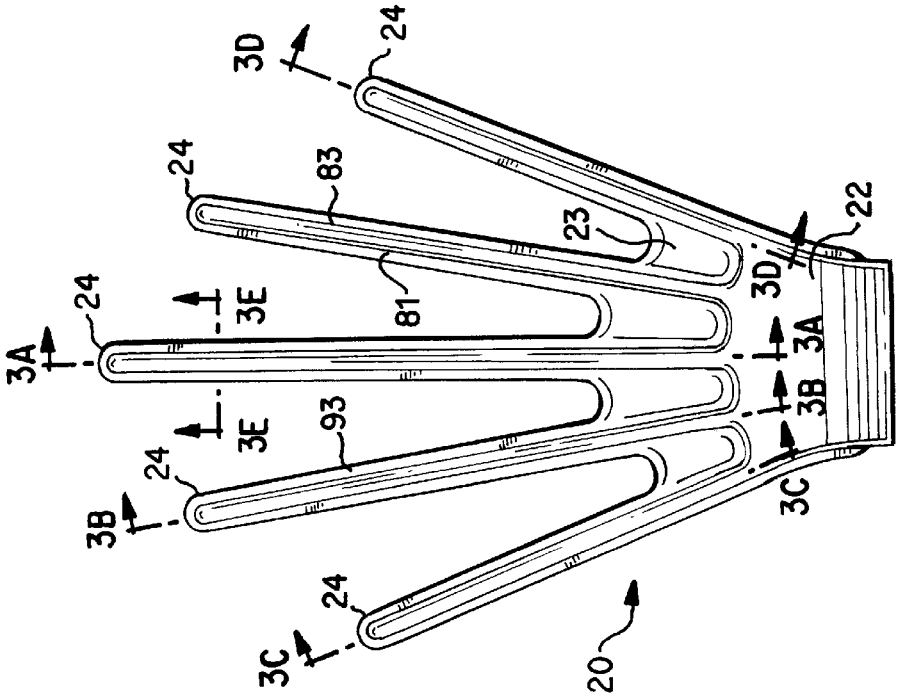
FIG. 3 is an illustration of a lateral support element in accordance with the present invention.
Figure 4C:
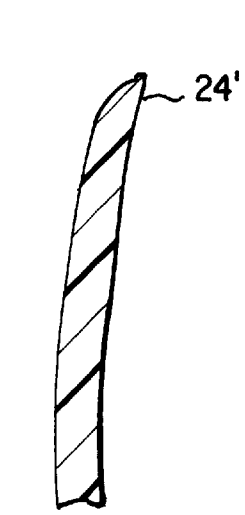
FIG. 4C is a cross section taken along the line C—C of FIG. 4.
Figure 4B:
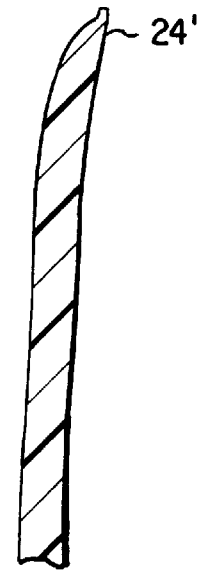
FIG. 4B is a cross section taken along the line B—B of FIG. 4.
Figure 4A:
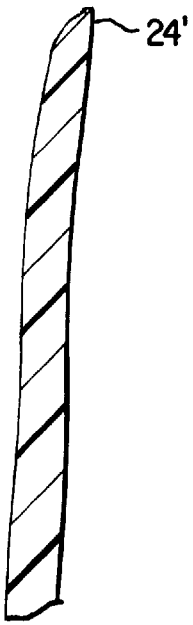
FIG. 4A is a cross section taken along the line A—A of FIG. 4.
Figure 4D:
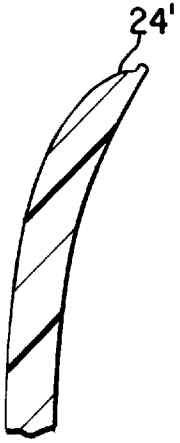
FIG. 4D is a cross section taken along the line D—D of FIG. 4.
Figure 4:
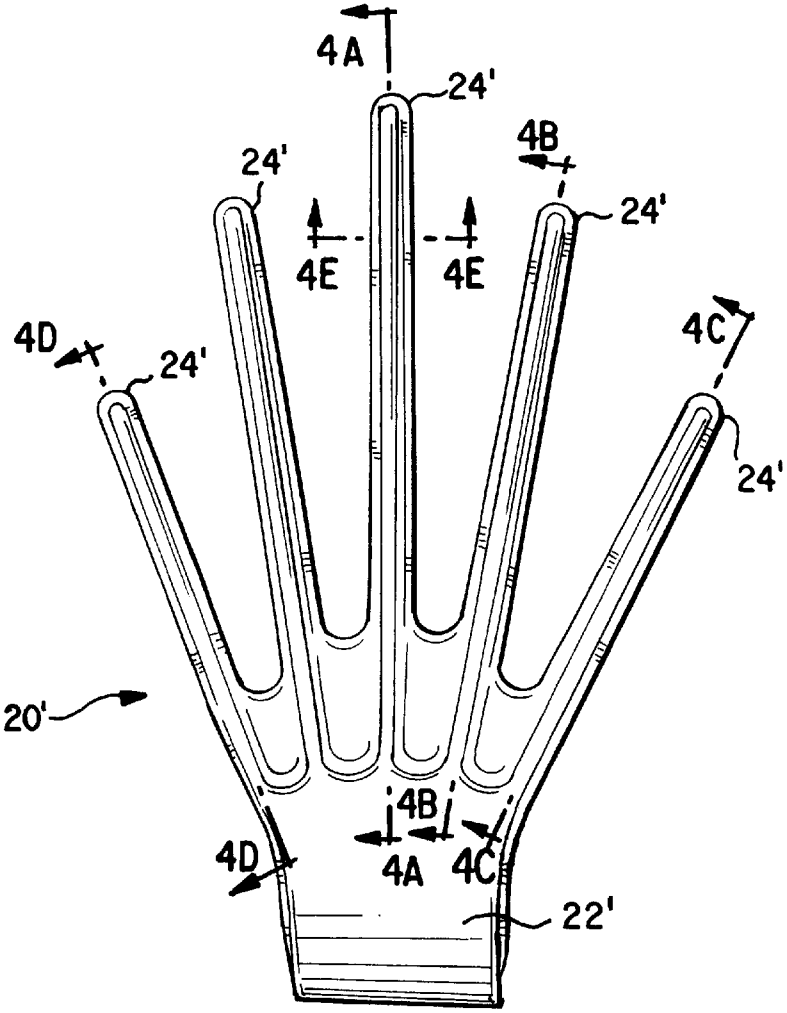
FIG. 4 is an illustration of a medial support element in accordance with the present invention.
Figure 4E:
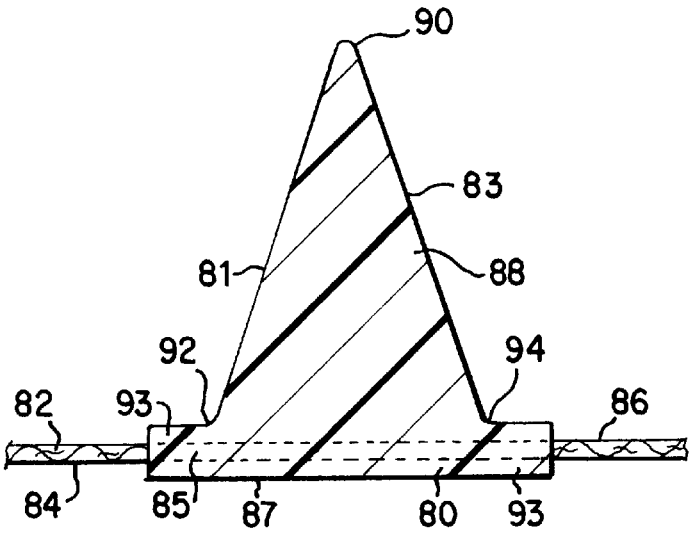
FIG. 4E is a cross section taken along the line E—E of FIG. 4.
Figure 4F:
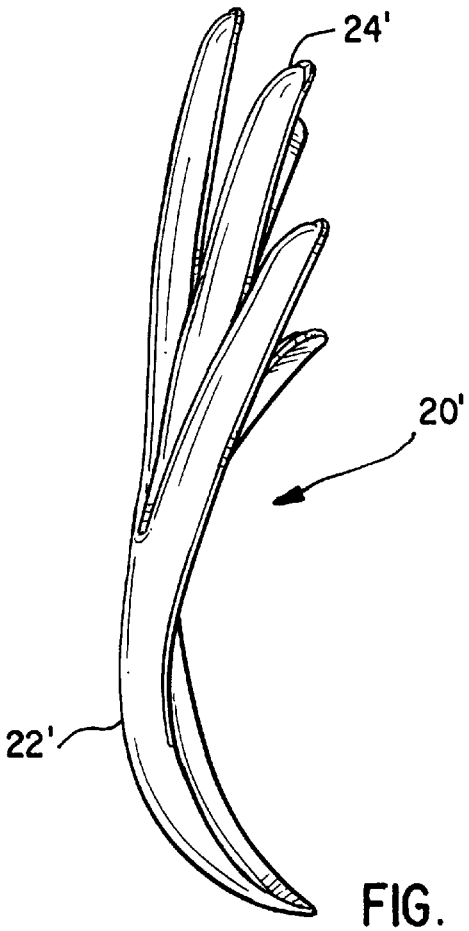
FIG. 4F is a side view of the medial support of FIG. 4.

As illustrated in FIG. 3, a base 22 and independently flexible finger-like support elements 24 are joined together to form a unitary support 20 in which the finger-like support elements 24 extend radially from the base 22. A web 23 is located between each of the finger-like support elements 24 and the base 22 to provide support to the lower portion of each finger-like element 24. Web 23 is formed as a layer of material, which is thinner in breadth than the finger-like support elements 24 and base 22, and extends from an inner surface of the finger-like support elements 24 and the base 22. Generally, the support 20 includes five finger-like support elements. However, it is possible to vary the number of elements depending on the amount of support needed and the size of the area being supported. FIG. 4 shows a support 20' which is substantially the same as support 20 except for the curvature of its finger-like support elements 24' and base 22', and the area it covers on the medial side of the article of footwear. For ease of explanation, only the lateral support 20 is described herein using reference numerals. It will be understood that this description also applies to the corresponding structural features of the medial support 20'.

Each finger-like support element 24 is flexible in the plantar/dorsi flexion plane and substantially rigid in the medial/lateral flexion plane. Plantar/dorsi flexion allows natural foot movement and flexion so that the performance of the athlete is not hindered while using the support. Substantial rigidity in the medial/lateral flexion plane eliminates unwanted medial/lateral movement while limiting inversion and eversion, increasing lateral stability and enhancing athletic performance. Support 20 does not restrict the amount of foot pronation and supination required to take a proper step. The support 20 is formed from a stiff, but resilient and bendable material. Preferably, such materials include a wide range of injection grade thermoplastics and nylon having a Shore-A durometer of 68–74, with a preferred durometer of between 70 and 72. More preferably, the material includes an approximately 70 durometer thermoplastic urethane which posses the preferred flexion characteristics. Another material which could be used includes a 30% carbon fiber reinforced nylon having a 72–75 Shore-A durometer. If necessary, additives in the form of glass and carbon fibers can be included in the chosen thermoplastics for strength.

Figure 3E:
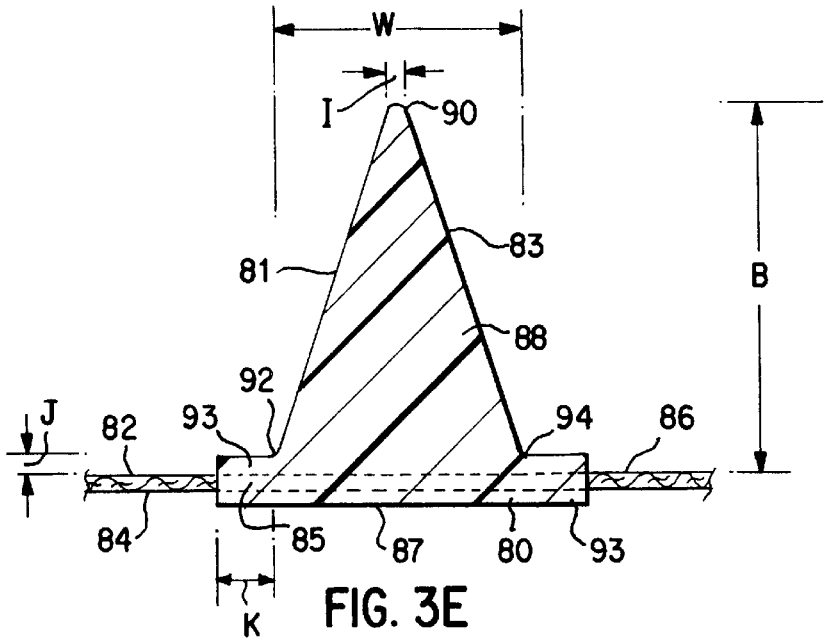
FIG. 3E is a cross section taken along the line E—E of FIG. 3.
Figure 3F:
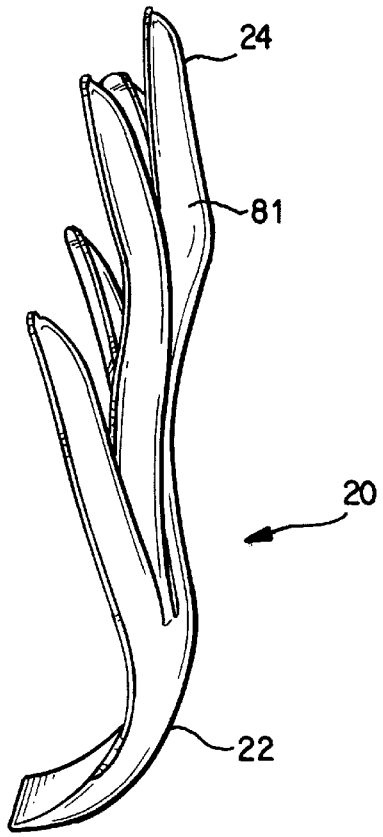
FIG. 3F is a side view of the lateral support of FIG. 3.

FIGS. 3A–3E show cross sections of the finger-like support elements 24. Each finger-like support element 24 has first and second sides 81, 83 which extend upward along its length and along the side of the upper 18. Each finger-like support element 24 also includes a first portion 80 located along a first, inner side 84 of a material substrate 82 of upper 18, a second portion 88 extending along a second, outer side 86 of substrate 82 and a bridge portion 85 extending through the material substrate 82 and connecting the first and second portions. Each element 24 further includes a width W, the distance the element extends along the longitudinal axis of the article of footwear, which varies as the element tapers away from the substrate 82 to a peak 90. The greatest extent of the width is between points 92 and 94 adjacent substrate 82 as shown in FIG. 3E. Flanges 93 are formed on both sides of substrate 82 along the sides of the first and second portions 80, 88. These flanges 93 create a double flange configuration which firmly holds the support elements 24 in place relative to the upper 18 and the article of footwear 10 without adding any substantial rigidity to the elements or impeding their flexion. The inner surface 87 of the first portion 80 comfortably lays against and follows a contour of the ankle region of the user.

As shown in FIG. 3E, peak 90 is spaced from the substrate 82 by the height or breadth B of the element 24, the distance the element extends outward away from the upper along a generally transverse horizontal axis of the article of footwear. The breadth B of each support element 24 is greater than its width W for a given length and gives the element 24 its strength to resist flexion in the medial/lateral plane and limit eversion and inversion. The greater the element's breadth B, the more resistance it will have to medial/lateral flexion. The breadth of each finger-like element is between about 3.75 mm and 8.0 mm with a preferred breadth of about 4.75 mm. The width W, a relatively small dimension over the length of each element, provides little resistance and allows substantially free flexion in the plantar/dorsi flexion direction. The width of each finger-like element is about 1.5 mm to 6.5 mm with a preferred width being about 2.5 mm. As shown in FIG. 3E, the width I of the peak of each finger is about 1.0 mm to 3.25 mm with a preferred width being about 1.6 mm; the thickness of each flange J is about 0.25 to 0.9 mm thick with a preferred thickness being about 0.375 mm; and the width K of each flange extending away from the finger-like elements is about 0.25 mm to 2.75 mm with a preferred width being about 0.75 mm.

Figure 5:
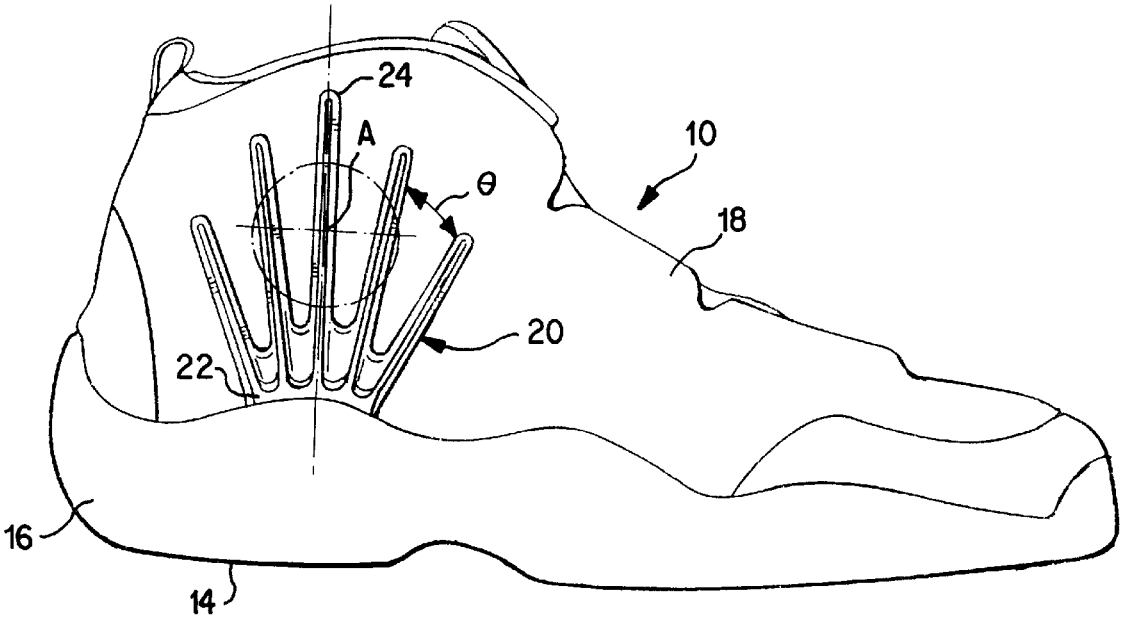
FIG. 5 is side elevational view illustrating a support according to the present invention centered about the ankle region of the user.

In the ankle region, the radially shaped support 20 is positioned on the article of footwear 10 and about the ankle. As shown in FIG. 5, the center of the support, which is approximately the center of the length of the middle finger-like element, is located over the malleolus and in line with the ankle's axis of rotation A when the user is in a neutral standing position. The finger-like elements 24 are splayed so as to cover and support the ankle region. They extend outwardly from the base at an angle Θ of between 10 and 20 degrees relative to each other. Preferably, the finger-like elements extend outwardly at an angle of about 14 degrees relative to each other. These elements extend in front of, behind, above and below the malleolus. In an alternative embodiment, the finger-like elements may extend upwardly from the base 22 in a substantially parallel relationship, relative to each other.

The support element 20 is contoured to conform to the underlying structure in the anatomy of the ankle while minimizing its own profile. The finger-like support elements 24 and the base 22 are curved in the medial and lateral directions to follow the contour of an average ankle and its surrounding area. The base 22 and a number of the finger-like elements 24 can have complex curvature in the medial and lateral directions to provide support above and below the malleolus. In one embodiment, as shown in FIGS. 7 and 8, the support elements 24 are also curved in the plantar and dorsi directions to assist in the flexion of the article of footwear in these directions.

Figure 6:
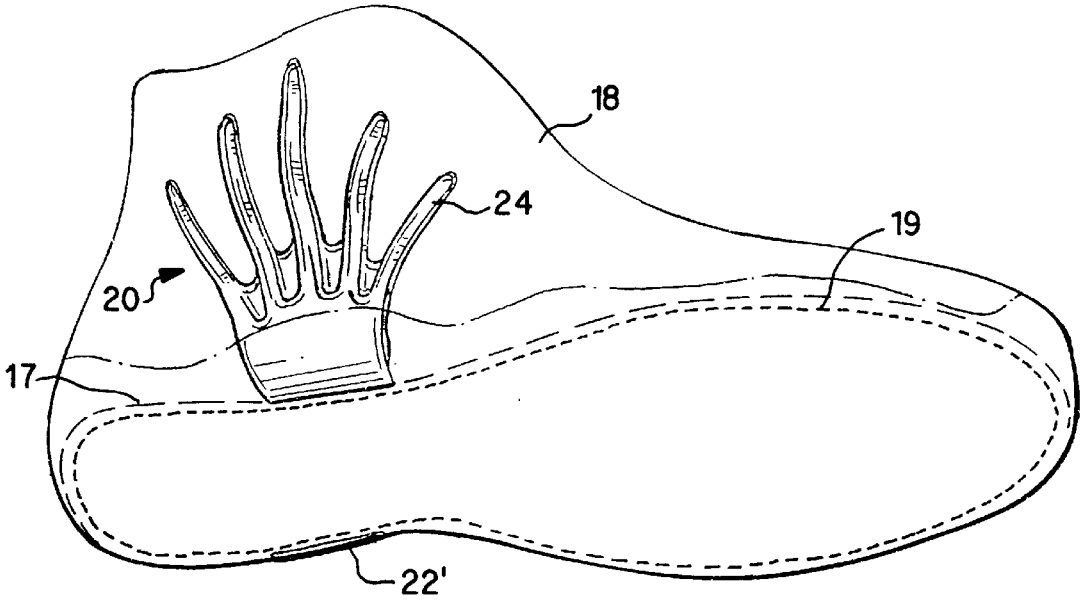
FIG. 6 is a bottom, perspective view showing the location of the supports on an article of footwear in accordance with the present invention.

As shown in FIG. 6, the base 22 is contoured and positioned on the article of footwear so that it curves into the footbed and stops at the featherline 17 of the article of footwear, just short of the strobel stitch line 19. Stopping the base 22 before the strobel stitch line 19 prevents the base 22 from pushing into the bottom of the foot when pressure is applied to the support. The base is preferably secured to the article of footwear by the midsole 16 or the outsole 14 if the article of footwear does not include a midsole. It is contemplated that the base can extend under the outsole if the support is not formed as part of the upper.

Figure 7:
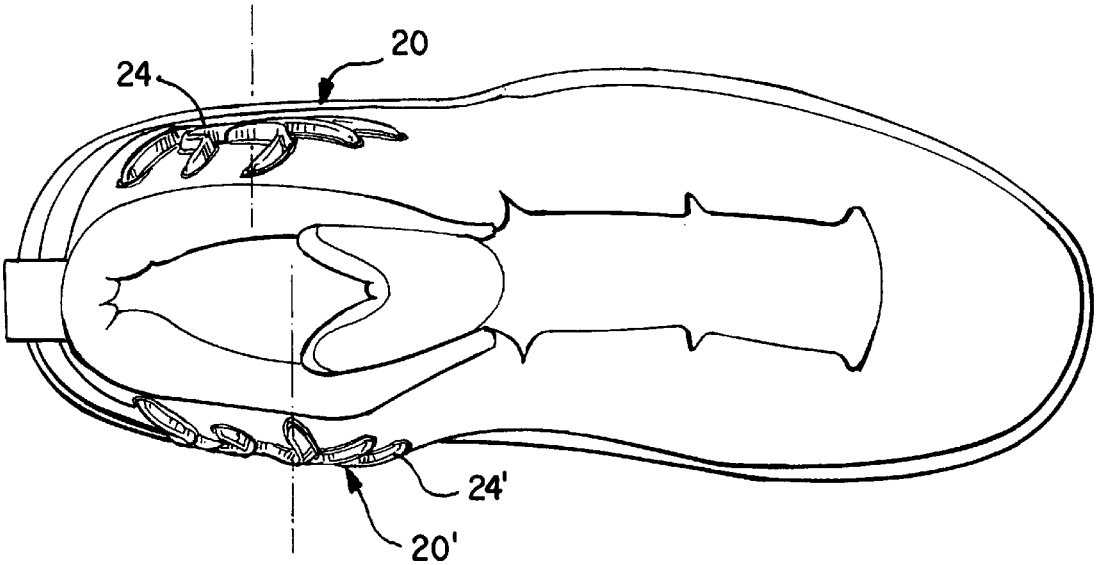
FIG. 7 is a top plan view showing supports in accordance with the present invention located along the medial and lateral sides of an article of footwear.
Figure 8:
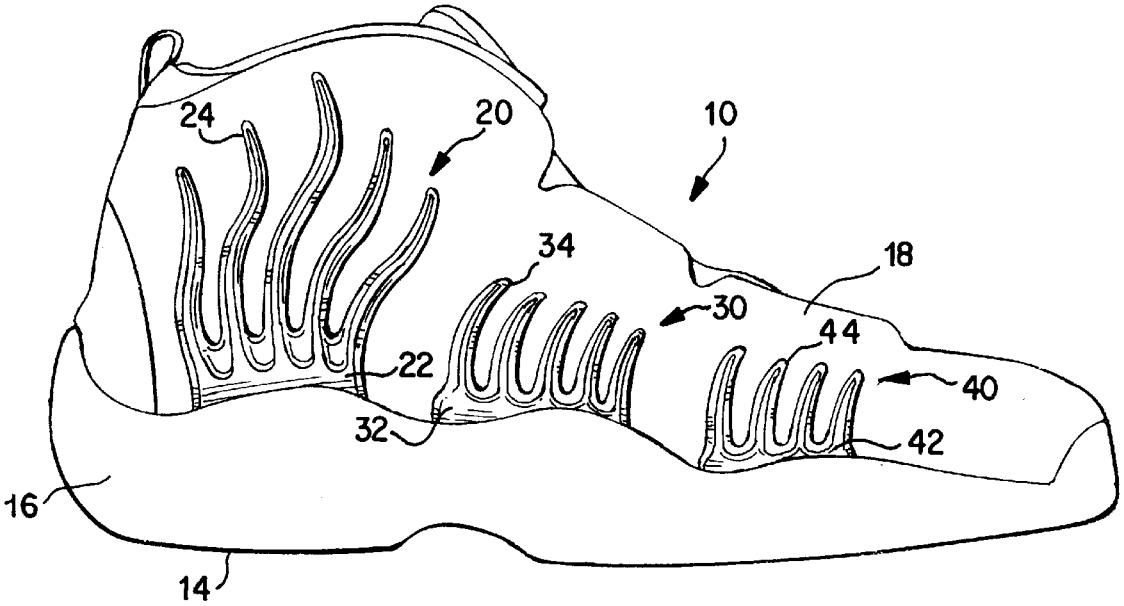
FIG. 8 is a side view illustrating supports in accordance with the present invention located along the length of the article of footwear.

As shown in FIG. 7, the supports 20 and 20' may be placed and centered about the malleolus on both the medial and lateral sides of the article of footwear 10. When placed on both sides, the supports 20 and 20' are offset from each other with the medial support located forward of the lateral support such that a line drawn between the center of each support base forms an acute angle with the longitudinal axis of the article of footwear. Offsetting the supports allows them to be properly positioned about the malleolus on each side. In one embodiment of the invention, the contour of the lateral support 20 differs from that of the medial support 20', shown in FIG. 4, so that each conforms to and supports the ankle on its respective side of the article of footwear.

FIG. 3 shows the support 20 for placement on the lateral side of right foot. The rearmost finger-like support element, shown in cross section in FIG. 3C, angles inwardly and is substantially flat along its length. The middle three finger-like support elements have complex curvature including inwardly facing concave and convex surfaces to compliment the contour of the outer malleolus and its surrounding areas. The forwardmost finger-like support element, shown in cross section in FIG. 3D, has a slight concavity near its terminal end.

FIG. 4 shows the support 20' for placement on the medial side of a right foot. The rearmost finger-like support element, shown in cross section in FIG. 4C, has slight inward curvature. The forwardmost finger-like support element, shown in cross section in FIG. 4D, has substantial inward curvature. FIG. 4A shows the cross section of the middle finger-like support element having complex curvature including inwardly facing concave and convex surfaces to compliment the contour of the inner malleolus and its surrounding areas. The two finger-like support elements intermediate the outermost and middle finger-like support elements have slight complex curvature including inwardly facing concave and convex surfaces. The forwardmost intermediate finger-like support element has a slightly greater inwardly facing concavity near its terminal end than does the intermediate finger-like support element shown in FIG. 4B.

As shown in FIG. 8, a plurality of supports can be incorporated into the article of footwear along its length for supporting the foot and increasing athletic performance. These support structures are located in at least the ankle, mid-foot, and forefoot regions of the article. When worn, the ankle support 20 is centered over the malleolus and supports the ankle of the wearer as discussed above. The mid-foot support 30 stabilizes the foot and enhances the fit of the article of footwear about the instep, while the forefoot support 40 positions the foot over the sole and prevents it from pushing out of the upper or separating the upper from the sole during use. Supports 30 and 40 each include a base 32, 42 and a plurality of finger-like support elements 34, 44 as discussed above with respect to support 20. Supports 30 and 40 can also be placed on either or both sides of the article of footwear.

The Shore-A durometer hardness of the finger-like elements can differ between the ankle region and the mid-foot and forefoot regions. The ankle support 20 is the most resistant to bending in the medial and lateral flexion plane. When the article of footwear is worn, the ankle region support elements 24 are located about the ankle and cover the malleolus as previously discussed. These elements 24 are primarily responsible for limiting inversion and eversion. While support elements 34 and 44 assist in limiting inversion and eversion, they are primarily responsible for containing the medial/lateral movements of the foot and enhancing the fit and performance of the article of footwear. Mid-foot support elements 34 enhance the fit of the article of footwear by supporting and containing the instep and the surrounding area. Forefoot elements 44 position the foot over the sole and prevent the foot from pushing through the upper or separating the upper from the sole. Mid-foot support elements 34 and forefoot support elements 44 have a Shore-A durometer of between 30 and 34. Preferably the durometer of these support elements 34, 44 is about 32.

The supports can be attached to the article of footwear by methods which include adhesive bonding or encasing the supports between layers of the article of footwear. A preferred method of forming and securing a support to the article of footwear includes injection molding it onto a portion of the article of footwear upper 18, specifically the material substrate 82 of upper 18. The method includes providing a mold having two opposing cavities and positioning the material substrate 82 so that it is held taught between the two cavities during the molding process. A thermoplastic is injected onto the material substrate 82 when it is positioned between the two cavities. The first and second portions 80, 88 of the finger-like support elements 24, including their flanges 93, are molded onto the first and second sides of the substrate 82, respectively. Bridge portion 85 which connects the portions 80, 88 of the finger-like elements 24, as well as the double flange, is formed by the thermoplastic flowing through the material. The base 22 is injection molded so that first and second portions of the base 22, formed on the first and second sides of the material substrate 82, respectively, are also connected by a bridging portion. In one embodiment of the method, the support is molded on a die cut material substrate which is then stitched or attached to the upper in a conventional manner. The support can also be molded directly onto a lasted upper.

Substrate materials used for this injection molding process include a wide range of fabrics, textiles and leathers with the greatest bonding strength occurring with open weave textiles. The materials should have sufficient porosity to allow the thermoplastic material to flow through them and form the bridge portion 85 between the first and second portions 80, 88 of the support 20. The materials used are limited by their melting points relative to the temperatures experienced during the injection molding of the support. Preferably, the material includes any permeable upper textile. More preferably, the material includes a permeable synthetic mesh material formed from a nylon or polyester double needle bar Rachel construction, such as a spacer mesh. It is contemplated that the support could be formed and used without being molded to the side of the article of footwear.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention.

We claim:

1. An article of footwear having a longitudinal axis extending between a heel region and a toe region, and a transverse axis extending substantially perpendicular to said longitudinal axis between medial and lateral sides of the article of footwear, said article of footwear comprising:

an upper and a sole; and at least one support including at least one finger-like support element extending along said upper, said at least one finger-like support element having a breadth extending a distance generally away from said upper and a width extending a distance generally along said upper, said distance that said breadth extends away from said upper being greater than said distance that said width extends along said upper so that said at least one finger-like element is capable of flexing in a plantar/dorsi flexion plane and resists flexing in a medial/lateral flexion plane for limiting eversion/inversion.

2. The article of footwear of claim 1 further comprising a finger-like support element base secured to said sole; and said at least one finger-like support element includes a plurality of radially extending finger-like support elements.

3. The article of footwear of claim 2 wherein the finger-like support elements extend vertically upward from said base and are secured to said upper.

4. The article of footwear of claim 3 wherein said support element base extends vertically upward along said upper.

5. The article of footwear of claim 1 wherein said at least one finger-like support element includes a complex curve in the plantar/dorsi flexion plane for aiding in flexion of said article of footwear when worn.

6. The article of footwear of claim 1 wherein said at least one support includes a plurality of supports spaced along said upper and each of said supports includes a plurality of said finger-like support elements.

7. The article of footwear of claim 6 wherein said plurality of support sections includes an ankle section, a mid-foot section and a forefoot section.

8. The article of footwear of claim 7 wherein said ankle section is substantially rigid in said medial/lateral flexion plane.

9. The article of footwear of claim 8 wherein said ankle section is positioned over a malleolus of the user when said article of footwear is worn.

10. The article of footwear of claim 7 wherein said mid-foot section is less rigid than said ankle section in said medial/lateral flexion plane and enhances a fit of said article of footwear when worn.

11. The article of footwear of claim 1 wherein said at least one finger-like support element includes a thermoplastic material.

12. The article of footwear of claim 1 wherein said upper includes a mesh material to which said at least one finger-like support element is secured.

13. The article of footwear of claim 1 wherein said at least one finger-like support element has a cross-section which tapers as said element extends away from said upper along said transverse axis.

14. The article of footwear of claim 1 wherein said at least one support includes at least two supports with one of said supports located on the medial side of the article of footwear and the other of said supports located on the lateral side of the article of footwear.

15. The article of footwear of claim 14 wherein said at least two supports are offset from one another such that a line drawn between a center line of each of said at least two supports is at an acute angle to the longitudinal axis of said article of footwear.

16. The article of footwear of claim 1 wherein said at least one support has complex curvature in said medial and lateral directions for conforming to the shape of an ankle of a user.

17. An article of footwear having medial/lateral support for limiting eversion/inversion comprising:

an upper and a sole attached to each other;

a support for limiting flexion in a medial/lateral flexion plane, said support including a plurality of spaced apart, radially extending finger-like support elements and a support base;

said support base secured to said sole and said finger-like support elements extending upwardly from said base along said upper, each said finger-like support element having a breadth extending away from said upper a greater distance than said respective finger-like support element extends along said upper; and said base including a lower portion which extends a distance along said sole in a direction transverse to a longitudinal axis of said article of footwear, said distance being sufficient to support said base without effecting the comfort of the user while wearing the article of footwear.

18. The article of footwear of claim 17 wherein said support includes a relatively stiff, resilient material.

19. The article of footwear of claim 18 wherein said material comprises a thermoplastic resin.

20. The article of footwear of claim 17 wherein said base is contoured to follow the curves of an ankle and a foot of a user when worn.

21. The article of footwear of claim 17 wherein said base curves into a footbed at a featherline of said article of footwear and is located between said upper and said sole.

22. An article of footwear having increased support for limiting inversion/eversion comprising:

an upper operatively attached to a sole and extending between a heel area and a toe area of said article of footwear;

a radially shaped support extending along said upper and including a base and at least one flexible finger-like support element extending away from said base and along said upper, said at least one finger-like support element extends a first distance away from said upper and a second distance along said upper, said first distance being greater than said second distance such that said finger-like support element easily flexes in a heel/toe flexion plane and resists flexion in a direction perpendicular to said heel/toe flexion plane; and said support having a contour which conforms to curvatures of an ankle region of a user so that the article of footwear comfortably receives and supports an ankle when worn.

23. The article of footwear of claim 22 wherein said at least one flexible finger-like support element comprises a plurality of spaced apart finger-like support elements extending upwardly from said base along said upper to support an ankle region when the article of footwear is worn.

24. The article of footwear of claim 23 wherein said contour of each said finger-like support element includes curvature in at least a medial/lateral plane in order to conform to an ankle region of a user.

25. The article of footwear of claim 23 wherein said contour of said base includes curvature in at least a medial/lateral plane in order to conform to a natural curve and contour of an ankle region and foot of a user.

26. The article of footwear of claim 23 wherein said plurality of finger-like support elements are positioned on said article of footwear such that they are centered over an ankle joint of a user when said user is in a neutral standing position.

27. The article of footwear of claim 23 wherein said plurality of finger-like support elements are spread out over an ankle region of said upper.

28. The article of footwear of claim 23 wherein said plurality of finger-like support elements are joined at said base by a web.

29. The article of footwear of claim 23 wherein each said finger-like support element is independently flexible.

30. The article of footwear of claim 22 wherein said article of footwear further comprises a plurality of radially shaped supports each having a plurality of spaced apart finger-like support elements.

31. The article of footwear of claim 22 wherein said finger-like support element includes a thermoplastic material.

* * * * *